US006607226B1

(12) United States Patent
Poncy

(10) Patent No.: US 6,607,226 B1
(45) Date of Patent: Aug. 19, 2003

(54) TOILET-DISPOSABLE BAG FOR AQUEOUS DISPOSAL

(76) Inventor: Mark Poncy, 2118 Ridgepole Dr., Box #370, Sky Valley, GA (US) 30537

( * ) Notice: Subject to any disclaimer, the term of this patent is extended or adjusted under 35 U.S.C. 154(b) by 0 days.

(21) Appl. No.: 09/679,380

(22) Filed: Oct. 5, 2000

Related U.S. Application Data

(60) Provisional application No. 60/165,912, filed on Nov. 17, 1999.

(51) Int. Cl.[7] ..... A01K 29/00; A41D 19/00

(52) U.S. Cl. ..... 294/25; 294/1.3; 2/159; 2/167

(58) Field of Search ..... 294/1.3, 25; 2/158, 2/159, 161.6, 161.7, 167; 428/35.4, 35.9, 35.2

(56) References Cited

U.S. PATENT DOCUMENTS

| | | | | | |
|---|---|---|---|---|---|
| 3,413,229 | A | | 11/1968 | Bianco et al. | |
| 4,348,293 | A | * | 9/1982 | Clarke et al. | 252/99 |
| 4,367,750 | A | | 1/1983 | Levine | 128/138 |
| 4,515,841 | A | * | 5/1985 | Dyke | 294/1.3 |
| 4,645,251 | A | * | 2/1987 | Jacobs | 294/1.3 |
| 4,768,818 | A | * | 9/1988 | Kolic | 294/1.3 |
| 4,788,733 | A | * | 12/1988 | Lerner | 294/1.3 |
| 4,845,781 | A | | 7/1989 | Strickland et al. | 294/1.3 |
| 4,902,283 | A | | 2/1990 | Rojko et al. | 294/1.3 |
| 4,937,881 | A | | 7/1990 | Heise | 294/1.3 |
| 4,959,881 | A | * | 10/1990 | Murray | 294/1.3 |
| 5,020,159 | A | | 6/1991 | Hellickson | 2/158 |
| 5,108,807 | A | * | 4/1992 | Tucker | 428/35.2 |
| 5,110,390 | A | * | 5/1992 | Martini et al. | 156/244.11 |
| 5,127,127 | A | | 7/1992 | Jorosinski | 2/159 |
| 5,272,191 | A | * | 12/1993 | Ibrahim et al. | 524/35 |
| 5,283,090 | A | * | 2/1994 | Umemura | 428/35.4 |
| 5,301,806 | A | * | 4/1994 | Olson | 294/1.3 |
| 5,406,649 | A | | 4/1995 | Bolembach | 2/158 |
| 5,679,421 | A | | 10/1997 | Brinton | 248/34.3 |
| 5,704,670 | A | * | 1/1998 | Surplus | 294/25 |
| 5,799,331 | A | | 9/1998 | Stewart | 2/159 |
| 5,827,586 | A | * | 10/1998 | Yamashita et al. | 428/36.6 |
| 5,869,193 | A | | 2/1999 | Langley | 2/157 |
| 5,871,679 | A | | 2/1999 | Honeycutt | 264/185 |
| 5,987,645 | A | | 11/1999 | Teaster | 2/159 |
| 6,058,882 | A | * | 5/2000 | Leuholt | 294/1.3 |
| 6,066,120 | A | * | 5/2000 | Whiteside | 604/332 |
| 6,102,457 | A | * | 8/2000 | Smith | 294/1.3 |
| 6,203,080 | B1 | * | 3/2001 | Surplus | 294/1.3 |
| 6,237,971 | B1 | * | 5/2001 | Ward Gilley | 294/1.3 |

FOREIGN PATENT DOCUMENTS

| | | | | |
|---|---|---|---|---|
| DE | 2187927 | * | 9/1987 | 294/1.3 |
| DE | 4131053 | * | 4/1993 | 2/159 |
| FR | 2587876 | * | 4/1987 | 294/1.3 |
| FR | 2645188 | * | 10/1990 | 294/1.3 |
| JP | 0022701 | * | 1/1989 | 294/1.3 |

* cited by examiner

*Primary Examiner*—Eileen D. Lillis
*Assistant Examiner*—Paul T. Chin
(74) *Attorney, Agent, or Firm*—Richard L. Aitken

(57) ABSTRACT

A multiple layered bag comprising such materials that one surface of the bag degrades when it comes in contact with water, for example polyvinyl alcohol, while the other surface is water resistant, such that the bag can be used to collect moist materials, for example pet excrement, without exposing the bag handler to those moist materials, yet when the everted bag is subjected to an aqueous environment, with the liquid degradable surface exposed to the aqueous environment, all the components of the bag degrade. The bag degrades such that the remaining components of the bag and the contents thereof are easily flushed down the toilet.

17 Claims, 1 Drawing Sheet

TOILET-DISPOSABLE BAG FOR AQUEOUS DISPOSAL

This application claims the benefit of provisional application Serial No. 60/165,912, filed Nov. 17, 1999.

BACKGROUND OF THE INVENTION

Responsible pet ownership has come to constitute more than just feeding and walking one's dog. Pet excrement deposited in public places is not only aesthetically unappealing, but poses numerous health risks and can adversely effect the environment. Exposure to pet excrement can result in *E. coli* (*Escherichia coli*) bacteria or roundworm infestation; and *E. coli* bacteria and roundworms can survive in tainted soil long after the excrement has degraded. Further, improperly disposed of pet excrement can be transferred into our waterways by storm water, potentially leading to water pollution that can reach hazardous levels and threaten aquatic life.

What was once considered to be exclusively an urban concern is no longer isolated to that context, as greater public awareness of the health concerns created by publicly deposited pet excrement, and laws and ordinances created in response thereto, have resulted in increased numbers of pet owners who responsibly "clean up" after their pets. Unfortunately, "cleaning up" after one's pet is inconvenient and requires special considerations. Specifically, the actual process of collecting pet excrement can be discomforting and unsanitary; the excrement itself cannot be discarded in just any trash receptacle, due to the obvious differences between excrement and typical garbage items; and the materials used to collect pet excrement, such as slow or non-degrading plastic bags, often introduce other environmental issues. The present invention resolves the aforementioned issues by minimizing the personal discomfort and unsanitary circumstances associated with collecting pet excrement, while allowing for convenient and environmentally conscious disposal of the excrement in an ordinary toilet.

The present invention relates to: Biodegradable bags that will degrade when immersed in an aqueous environment but will resist degradation when only the exterior surface of the bag comes in contact with liquid; A process for manufacturing biodegradable bags that will degrade when immersed in an aqueous environment but will resist degradation when only the exterior surface of the bag comes in contact with liquid; and A method for using biodegradable bags that will degrade when immersed in an aqueous environment but will resist degradation when only the exterior surface of the bag comes in contact with liquid to pick up pet excrement and dispose of such excrement in an ordinary toilet.

U.S. Pat. No. 5,679,421 describes a biodegradable bag of two ply construction, comprising an inner layer of specific thermoplastic materials and an outer paper layer. The materials are all biodegradable and the thermoplastic materials selected are purportedly resistant to the passage of liquid there through. Of the thermoplastic materials described, those that successfully resist the passage of water there through do not degrade in an aqueous environment and those that are degradable in an aqueous environment do not resist the passage of water there through and are hence inappropriate for using to pick up pet excrement.

U.S. Pat. No. 4,902,283 describes an absorbable cleaning mitt for wiping babies that allows the user to clean a baby with the absorbing cotton exterior, while completely protecting the user's hand from that which is being cleaned off of the baby. However, the described mitt is not biodegradable.

SUMMARY OF THE INVENTION

The primary objective of the present invention is to provide a multiple layered bag of such materials that one surface of the bag degrades when it comes in contact with water, while the other surface is water resistant, such that the bag can be used to collect moist materials, for example pet excrement, without exposing the bag handler to those moist materials, yet when the everted bag is subjected to an aqueous environment, with the liquid degradable surface exposed to the aqueous environment, all the components of the bag degrade. The bag degrades such that the remaining components of the bag and the contents thereof are easily flushed down the toilet.

BRIEF DESCRIPTION OF THE DRAWING

By way of further explanation of the invention, exemplary embodiments of the invention will now be described with reference to the accompanying drawings, in which.

DESCRIPTION OF THE PREFERRED EMBODIMENTS

The apparatuses shown in the accompanying drawing and described below are examples that embody the invention. It should be noted that the scope of the invention is defined by the accompanying claims, and not necessarily by specific features of exemplary embodiments.

Figure 1:
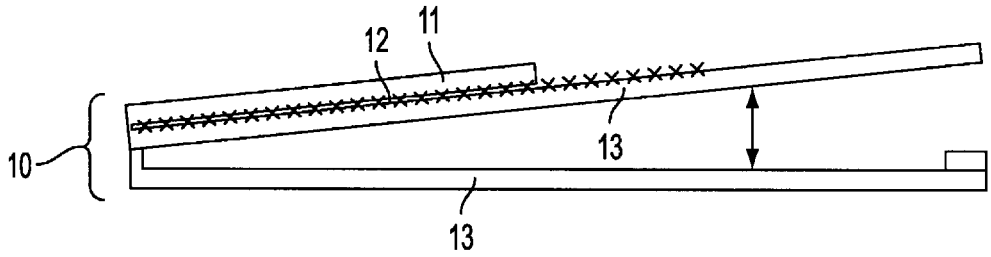
FIG. 1 is a cross-section of a multiple layered bag, which embodies the invention.

FIG. 1 shows a multiple layered bag 10, having an interior layer 13 made of water-soluble plastic material, like polyvinyl alcohol, an intermediary layer 12 made of water retardant material, like silicone, and an exterior layer 11 made of biodegradable paper, like kraft paper.

Polyvinyl alcohol resins are available in a number of grades of degree of hydrolysis and molecular weight. The degree of hydrolysis and the molecular weight influence the solubility of polyvinyl alcohol resins, but the degree of hydrolysis is by far the more significant of the two variables. For quick dissolution in cold water, resins having a degree of hydrolysis of up to 88% are typically used. Resins having a degree of hydrolysis of 96% to 99.5% are considered to be hot water-soluble only. Resins having a degree of hydrolysis of 88% to 95% can be considered as intermediate in solubility characteristics or "warm water-soluble". By using combinations of these resins in a water-soluble plastic material formulation, varying degrees of water solubility at given temperatures can be achieved. Variations in the molecular weights of the resins can also influence the water solubility. As such, the formula of the polyvinyl alcohol resin used for the multiple layered bags is modified or selected so that the molecular weight and/or the degree of hydrolysis of the polyvinyl alcohol resin result in the onset of disintegration following exposure to an aqueous environment being preferably delayed for a period ranging from five minutes to one hour or thirty seconds to two hours. At a minimum, the onset of disintegration should be delayed at least thirty seconds to give user time to dispose of the bag and its contents after picking up a moist substance. At the outside, the delay should be no greater than two hours to assure that disintegration begins within a reasonable time after disposal.

The bag sheet material can be made by spraying the water retardant material 12 on one surface of the water-soluble plastic material 13, then laminating or pressure adhering the biodegradable paper 11 on the water retardant material 12 covered surface of the water-soluble plastic material 13. Selected areas of two sheets of the multiple layered bag material are joined together, to form a bag construction 10 having an interior layer 13 made of water-soluble plastic material and an exterior layer 11 made of biodegradable paper. Alternatively, selected areas of one sheet of the multiple layered bag material are joined together, to form a bag construction 10 having an interior layer 13 made of water-soluble plastic material and an exterior layer 11 made of biodegradable paper.

Alternatively, the bag sheet material can be made by spraying the water retardant material 12 on one surface of the biodegradable paper 11, then laminating, pressure adhering, or spraying the water-soluble plastic material 13 on the water retardant material 12 covered surface of the biodegradable paper 11. Selected areas of two sheets of the multiple layered bag material are joined together, to form a bag construction 10 having an interior layer 13 made of water-soluble plastic material and an exterior layer 11 made of biodegradable paper. Alternatively, selected areas of one sheet of the multiple layered bag material are joined together, to form a bag construction 10 having an interior layer 13 made of water-soluble plastic material and an exterior layer 11 made of biodegradable paper.

As another alternative, the bag sheet material can be made by creating one layer composing both the water retardant material 12 and the biodegradable paper 11, by adding the water retardant material 12, a resinous or starch-like material, during the slurry phase of the biodegradable paper 11 manufacture, then laminating, pressure adhering, or spraying the water-soluble plastic material 13 on the water retardant biodegradable paper 12 and 11. Selected areas of two sheets of the multiple layered bag material are joined together, to form a bag construction 10 having an interior layer 13 made of water-soluble plastic material and an exterior layer 11 made of biodegradable paper. Alternatively, selected areas of one sheet of the multiple layered bag material are joined together, to form a bag construction 10 having an interior layer 13 made of water-soluble plastic material and an exterior layer 11 made of biodegradable paper.

Figure 2:
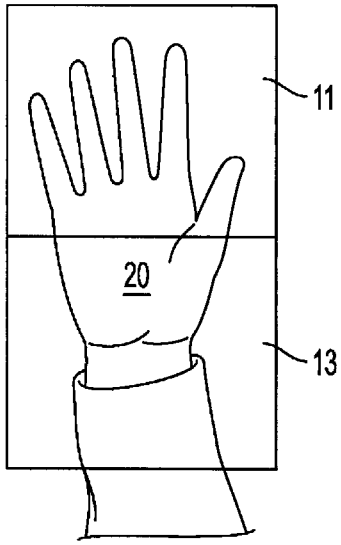
FIG. 2 is a pictorial view of a multiple layered bag with a hand inserted therein.

FIG. 2 shows a multiple layered bag 10 with a hand 20 inserted in the multiple layered bag in such a manner that the hand comes in contact with the water-soluble plastic material interior layer 13 and the exterior biodegradable paper layer 11 covers at least a portion of the bag surface that covers the palmar side of the multiple layered bag 10. The palmar side of the hand 20 is covered by all layers 11, 12, and 13 of the bag 10 so that when the bag 10 covered palmar side of the hand 20 comes in contact with waste materials for disposal 30, such as pet excrement, the biodegradable paper layer 11 acts to protect the hand 20 from the unpleasant feeling of coming into contact with the waste material 30 and the water retardant layer 12 prevents physical contact between the hand 20 and any components of the waste material 30, including liquids. Once the palmar side of the bag 10 protected hand 20 is used to collect the waste material, the hand 20 is removed from the bag 10 in such a manner that the bag 10 is everted, leaving the waste material 30 inside the everted bag 10, with the water-soluble plastic material layer 13 now the exterior layer.

Figure 3:
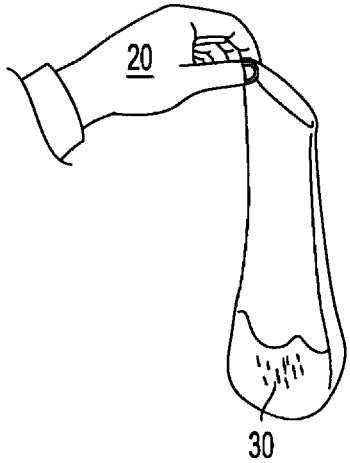
FIG. 3 is a pictorial view of an everted multiple layered bag containing pet excrement.

FIG. 3 shows a multiple layer bag 10 that has been everted, contains waste material 30, and is being carried by a hand 20. As the waste material 30 has only come in contact with the biodegradable paper layer 11 and not the water-soluble plastic layer 13, the user can safely hold the everted bag 10 by the water-soluble plastic layer 13, such that the hand does not come in contact with the waste material 30 or the biodegradable paper layer 11, which has come in contact with the waste material 30. The user can safely carry the everted bag 10 to an ordinary toilet, where the everted bag 10 can be discarded into the toilet and the aqueous environment degrades the water-soluble plastic layer 13 and the biodegradable paper layer 11, leaving the water retardant layer 12 with nothing to be attached to, and hence broken into molecular sized particles which can be flushed down the toilet along with the waste material 30 and the other components of the degraded bag 10.

The present invention describes biodegradable bags, processes for making such biodegradable bags, and methods, for using such biodegradable bags to collect waste materials, such as pet excrement, and dispose of such bags containing waste material in an ordinary toilet. However, it will be appreciated by those skilled in the arts pertaining thereto, that the present invention can be practiced in various alternate forms and configurations. Further, the previously detailed descriptions of the preferred embodiments of the present invention are presented for purposes of clarity of understanding only, and no unnecessary limitations should be implied therefrom. All appropriate mechanical and functional equivalents to the above, which may be obvious to those skilled in the arts pertaining thereto, are considered to be encompassed within the claims of the present invention.

What is claimed is:

1. A multiple layered bag comprising of a water-soluble plastic material layer and a laminated or pressure adhered biodegradable paper layer affixed to at least a portion of the surface of said water-soluble plastic material, wherein the formula of said water-soluble plastic material has been modified so that the onset of disintegration following exposure to an aqueous environment is delayed for a period in the range of thirty seconds to two hours, wherein a water retardant additive is incorporated into said biodegradable paper layer during manufacture of the biodegradable paper.

2. A multiple layered bag comprising of a water-soluble plastic material layer and a laminated or pressure adhered biodegradable paper layer affixed to at least a portion of the surface of said water-soluble plastic material, wherein the formula of said water-soluble plastic material has been modified so that the onset of disintegration following exposure to an aqueous environment is delayed for a period in the range of thirty seconds to two hours, whereby said multiple layered bag is manufactured by spraying said water-soluble plastic material onto a sheet of said biodegradable paper and two said sheets of said biodegradable paper sprayed with said water-soluble plastic material are joined along three perimeter edges of said sheets of said biodegradable paper sprayed with said water-soluble plastic material, such that said joined sheets of said biodegradable paper sprayed with said water-soluble plastic material form a multiple layered bag wherein said biodegradable paper layer is the exterior layer and said water-soluble plastic layer is the interior layer.

3. A multiple layered bag comprising: a water-soluble plastic material layer, a water retardant layer affixed to at least a portion of the surface of said water-soluble plastic material, and a laminated or pressure adhered biodegradable paper layer affixed to at least a portion of the surface of said water retardant layer, said water-retardant layer being in a form that disintegrates when said water-soluble layer dissolves.

4. A multiple layered bag, as described in claim 3, wherein said water-soluble plastic material is polyvinyl alcohol.

5. A multiple layered bag, as described in claim 4, wherein the formula of said polyvinyl alcohol has been modified so that the onset of disintegration following exposure to an aqueous environment is delayed for a period ranging from five minutes to one hour.

6. A multiple layered bag, as described in claim 5, wherein said water retardant layer is a layer of silicone.

7. A multiple layered bag, as described in claim 5, wherein said water retardant layer is affixed to said water-soluble plastic material by spraying said water retardant layer onto said water-soluble plastic material.

8. A multiple layered bag, as described in claim 4, wherein said water retardant layer is a layer of silicone.

9. A multiple layered bag, as described in claim 8, wherein said water retardant layer is affixed to said water-soluble plastic material by spraying said water retardant layer onto said water-soluble plastic material.

10. A multiple layered bag, as described in claim 4, wherein said water retardant layer is affixed to said water-soluble plastic material by spraying said water retardant layer onto said water-soluble plastic material.

11. A multiple layered bag, as described in claim 3, wherein said water retardant layer is a layer of silicone.

12. A multiple layered bag, as described in claim 11, wherein said water retardant layer is affixed to said water-soluble plastic material by spraying said water retardant layer onto said water-soluble plastic material.

13. A multiple layered bag, as described in claim 3, wherein said water retardant layer is affixed to said water-soluble plastic material by spraying said water retardant layer onto said water-soluble plastic material.

14. A multiple layered bag as recited in claim 3 wherein said water-soluble plastic material layer is inside of said water-retardant layer and said paper layer.

15. A multiple layered bag comprising: a water-soluble plastic material layer, a water retardant layer affixed to at least a portion of the surface of said water-soluble plastic material, and a laminated or pressure adhered biodegradable paper layer affixed to at least a portion of the surface of said water retardant layer, whereby said multiple layered bag is manufactured by spraying said water retardant layer onto a sheet of said biodegradable paper, said water-soluble plastic material is sprayed onto said water retardant layer, and two said sheets of said biodegradable paper sprayed with said water retardant layer and said water-soluble plastic are joined along three perimeter edges of said sheets of said biodegradable paper sprayed with said water retardant layer and said water-soluble plastic, such that said joined sheets of said biodegradable paper sprayed with said water retardant layer and said water-soluble plastic form a multiple layered bag wherein said biodegradable paper layer is the exterior layer, said water retardant layer is the intermediary layer, and said water-soluble plastic layer is the interior layer.

16. A method for using a multiple layered bag, as described in claim 3, for disposal of refuse, said method comprising:

(a) inserting a hand inside said multiple layered bag in such a manner that said biodegradable paper layer is on the exterior of said multiple layered bag and said biodegradable paper layer covers at least the palmar surface of the hand;

(b) collecting the waste material with the bagged hand in such a manner that said biodegradable paper layer comes in contact with the waste material;

(c) everting said multiple layered bag in such a manner that said multiple layered bag is removed from the hand and the waste material is inside of said everted multiple layered bag; and (d) depositing said waste material containing multiple layered bag in a toilet, where the exposed surface of said multiple layered bag dissolves, leaving no substrate on which said water retardant layer can reside, and allowing for hydration of said biodegradable paper layer and exposure of the waste material to the water.

17. A multiple layered bag comprising of a water-soluble plastic material layer, a water retardant layer affixed to at least a portion of the surface of said water-soluble plastic material, and a laminated or pressure adhered biodegradable paper layer affixed to at least a portion of the surface of said water retardant layer; said water-soluble plastic material layer being formed of polyvinyl alcohol; the formula of said polyvinyl alcohol having been modified so that the onset of disintegration following exposure to an aqueous environment is delayed for a period ranging from thirty seconds to two hours; said water retardant layer being formed of silicone; and said water retardant layer being affixed to said water-soluble plastic material by spraying said water retardant layer onto said water-soluble plastic material.

* * * * *